US011311073B2

(12) United States Patent
Chen et al.

(10) Patent No.: US 11,311,073 B2
(45) Date of Patent: Apr. 26, 2022

(54) SOLE FOR CYCLING SHOE

(71) Applicant: GIANT MANUFACTURING CO., LTD., Taichung (TW)

(72) Inventors: Chun-Hung Chen, Taichung (TW); Stan Mavis, Seattle, WA (US)

(73) Assignee: GIANT MANUFACTURING CO., LTD., Taichung (TW)

( * ) Notice: Subject to any disclaimer, the term of this patent is extended or adjusted under 35 U.S.C. 154(b) by 0 days.

(21) Appl. No.: 14/669,818

(22) Filed: Mar. 26, 2015

(65) Prior Publication Data

US 2016/0198792 A1 Jul. 14, 2016

(30) Foreign Application Priority Data

Jan. 9, 2015 (TW) ..... 104100662

(51) Int. Cl.

| | |
|---|---|
| ***A43B 5/14*** | (2006.01) |
| ***A43B 13/02*** | (2022.01) |
| ***A43B 13/18*** | (2006.01) |
| ***A43B 13/12*** | (2006.01) |
| ***A43B 13/14*** | (2006.01) |

(52) U.S. Cl.

CPC ..... *A43B 5/14* (2013.01); *A43B 13/026* (2013.01); *A43B 13/122* (2013.01); *A43B 13/145* (2013.01); *A43B 13/184* (2013.01)

(58) Field of Classification Search

CPC ... A43B 13/026; A43B 13/184; A43B 13/145; A43B 13/122; A43B 5/14

USPC ..... 36/31, 131

See application file for complete search history.

(56) References Cited

U.S. PATENT DOCUMENTS

| | | | | | |
|---|---|---|---|---|---|
| 1,484,785 | A * | 2/1924 | Hiss | A43B 7/144 | 36/76 R |
| 4,454,662 | A * | 6/1984 | Stubblefield | A43B 5/00 | 36/102 |
| 5,461,801 | A * | 10/1995 | Anderton | A43B 3/0052 | 24/713.4 |
| 5,822,889 | A * | 10/1998 | Ueda | A43B 5/14 | 36/131 |
| 5,924,220 | A * | 7/1999 | Ueda | A43B 5/14 | 36/131 |
| 5,943,795 | A * | 8/1999 | Ueda | A43B 5/14 | 36/131 |

(Continued)

FOREIGN PATENT DOCUMENTS

TW 200946050 A 11/2009

*Primary Examiner* — Jocelyn Bravo

(74) *Attorney, Agent, or Firm* — Finnegan, Henderson, Farabow, Garrett & Dunner L.L.P

(57) ABSTRACT

A sole for cycling shoe includes a forefoot section, a heel section and an arch section connected between the forefoot section and the heel section, a longitudinal axis and a tilting axis defined between the forefoot section and the heel section, a deviation angle defined between the tilting axis and the longitudinal axis, a middle part extending through the forefoot section, the arch section and the heel section, and two side wing portions defined at two opposite sides relative to the middle part. The rigidity of the middle part is higher than the two side wing portions. The middle part extends in the arch section along the tilting axis. Based on the above-described technical features, the overall structure of the sole has sufficient rigidity with enhanced torsionability on the rear end thereof, making the cycling shoe more comfort.

7 Claims, 9 Drawing Sheets

(56) References Cited

U.S. PATENT DOCUMENTS

| | | | | |
|---|---|---|---|---|
| 6,009,641 | A * | 1/2000 | Ryan | A43B 5/14 36/107 |
| 6,023,861 | A * | 2/2000 | Bizzotto | A43B 13/10 36/151 |
| 6,502,330 | B1 * | 1/2003 | David | A43B 3/0052 36/88 |
| 6,862,821 | B2 * | 3/2005 | Parisotto | A43B 5/002 36/30 R |
| 7,934,327 | B2 | 5/2011 | Gebhard | |
| 2001/0022041 | A1 * | 9/2001 | Gebhard | A43B 5/14 36/131 |
| 2004/0000071 | A1 * | 1/2004 | Auger | A43B 5/02 36/59 R |
| 2004/0000074 | A1 * | 1/2004 | Auger | A43B 13/10 36/102 |
| 2005/0210712 | A1 * | 9/2005 | Jau | A43B 5/14 36/131 |
| 2006/0010716 | A1 * | 1/2006 | Kerns | A43B 5/14 36/25 R |
| 2006/0080865 | A1 * | 4/2006 | Chao | A43B 5/14 36/131 |
| 2008/0276496 | A1 * | 11/2008 | Kerns | A43B 5/14 36/131 |
| 2009/0100718 | A1 * | 4/2009 | Gerber | A43B 13/145 36/128 |
| 2010/0192421 | A1 * | 8/2010 | Kerns | A43B 5/14 36/3 B |
| 2011/0138658 | A1 * | 6/2011 | Ueda | A43B 5/14 36/131 |
| 2013/0333248 | A1 * | 12/2013 | Auger | A43B 3/0052 36/134 |
| 2014/0082969 | A1 * | 3/2014 | Binzer | A43B 13/125 36/107 |

* cited by examiner

SOLE FOR CYCLING SHOE

BACKGROUND OF THE INVENTION

1. Field of the Invention

The present invention relates to cycling shoe technology and more particularly, to a sole for cycling shoe.

2. Description of the Related Art

With different environments and activities, shoes wearing on the feet of people have a wide range of types and shapes, so that in addition to the basic function of protecting the feet, the shoes can also provide special functions. For example, there are significant differences on the design requirements between walking shoes and sports shoes. Walking shoes emphasize stability and shock resistance. Sports shoes will have different performance requirements corresponding to different types of sports.

For example, when wearing cycling shoes for cycling sport, the cyclist steps the feet on the pedals and then alternatively pedals the pedals to ride the bike. As cycling shoes for cycling sport are to be directly coupled to the pedals, the shoes must have sufficient hardness and rigidity so that, in addition to the function of supporting the bicycle rider's legs in a high speed and powerful swinging operation, the cycling shoes can also increase the transmission efficiency of the pedaling force to further achieve the effect of labor-saving.

However, because the soles of conventional cycling shoes are commonly made from a hard material having high rigidity, they can restrict the mobility of the sole of the foot and the ankle, Due to the mobility of the joint is restricted, the rider is prone to discomfort on long rides. After a long ride, excessive friction between the feet and the cycling shoes can lead to sport injuries.

SUMMARY OF THE INVENTION

The present invention has been accomplished under the circumstances in view. It is the main object of the present invention to provide a sole for cycling shoe, which enhances transverse torsionability while maintaining sufficient longitudinal rigidity, letting the foot joints move free and making the cycling shoe more comfort.

To achieve this and other objects of the present invention, a sole for cycling shoe comprises a forefoot section, a heel section, and an arch section connected between the forefoot section and the heel section. The forefoot section and the heel section define therebetween a longitudinal axis and a tilting axis. The tilting axis and the longitudinal axis define therebetween a deviation angle. The sole comprises a middle part. The middle part extends over the forefoot section, the arch section and the heel section so that two side wing portions are defined on the sole at two opposite sides of the middle part. The rigidity of the middle part is higher than the rigidity of the side wing portions. Further, the middle part extends in the arch section along the tilting axis. Based on the above-described technical features, the overall structure of the sole has sufficient rigidity with enhanced torsionability on the rear end thereof, making the cycling shoe more comfort.

Preferably, the forefoot section comprises a mounting portion located at a bottom wall thereof. Further, the middle part extends from the front edge of the forefoot section through the center of the mounting portion and the arch section to the heel section.

Preferably, the middle part extends in the junction between the forefoot section and the arch section along the longitudinal axis.

Preferably, the middle part extends through the junction between the arch section and the heel section in a curved manner toward the border edge of the heel section.

Other advantages and features of the present invention will be fully understood by reference to the following specification in conjunction with the accompanying drawings, in which like reference signs denote like components of structure.

DETAILED DESCRIPTION OF THE INVENTION

Prior to reading the following specification in conjunction with the accompanying drawings, it is to be understood that a sole for cycling shoe in accordance with the present invention is not limited to the described specific structure, material, manufacturing technique, purpose and applied types of cycling shoes. The terms used in the specification are exemplary description terms an ordinary person skilled in the art can understand, and all the terms are used for describing specific embodiments but not intended to limit the scope of the invention. Further, the singular forms "a", "an" and "the" contain a plural meaning, for example, one component or device can be formed of one simple element or multiple elements, including its or their equivalents. All conjunctions used in a similar situation should also be understood to have the broadest sense. The specific shape, cross section and structural features or technical terms should be understood to include equivalent replacement structures or technical terms that can achieve the same functions.

Figure 1:
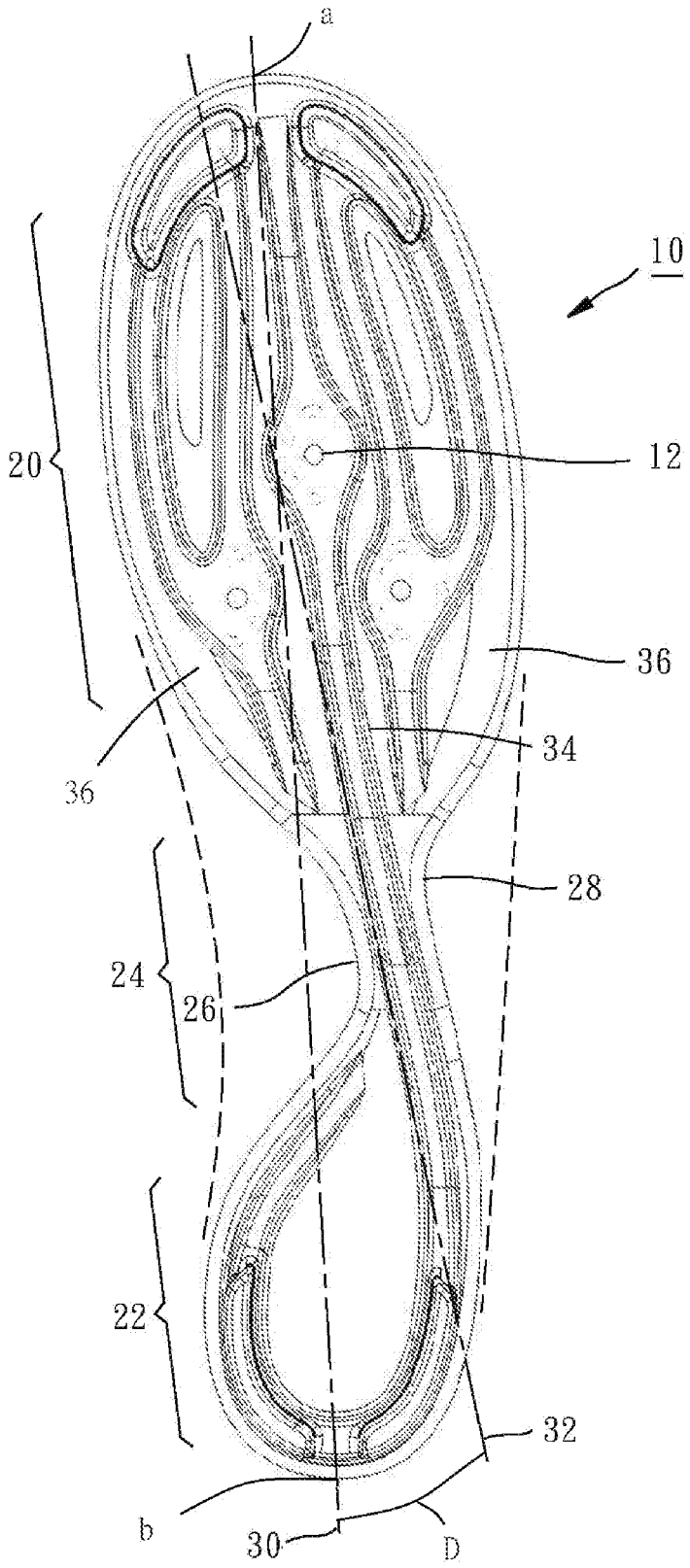
FIG. 1 is a front view of a sole for cycling shoe in accordance with a first embodiment of the present invention.
Figure 2:
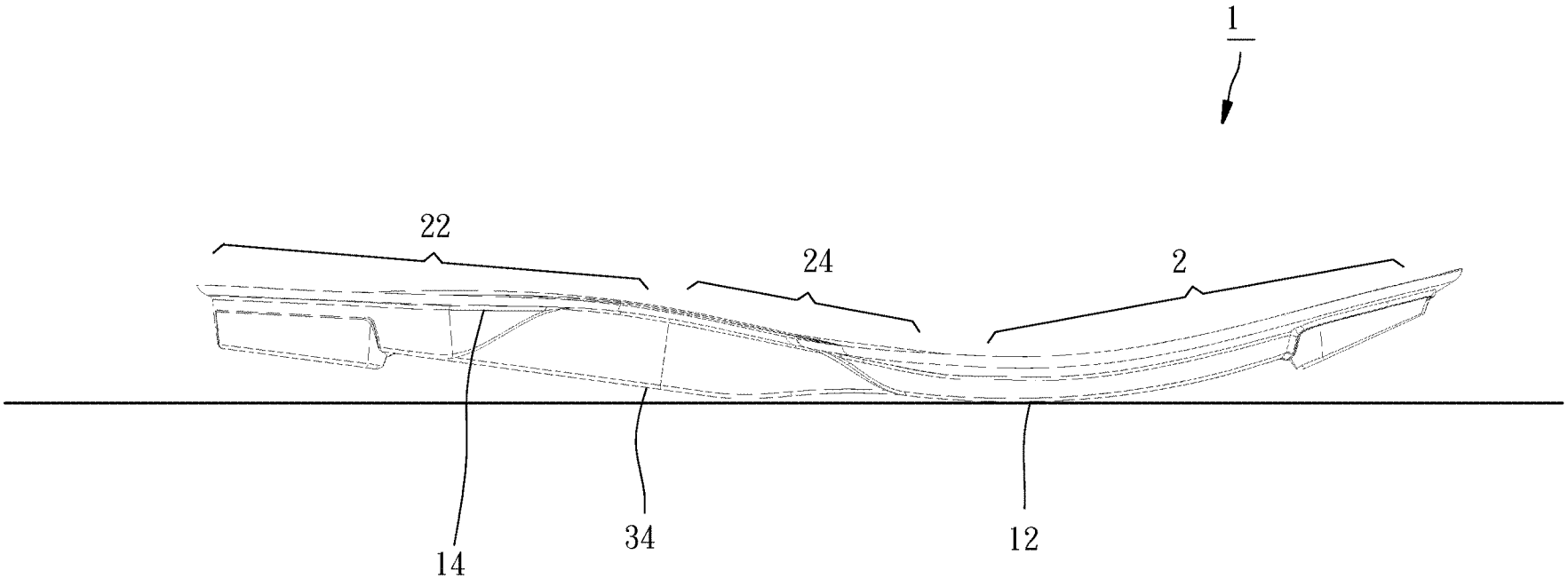
FIG. 2 is a side view of the sole for cycling shoe in accordance with the first embodiment of the present invention.
Figure 3:
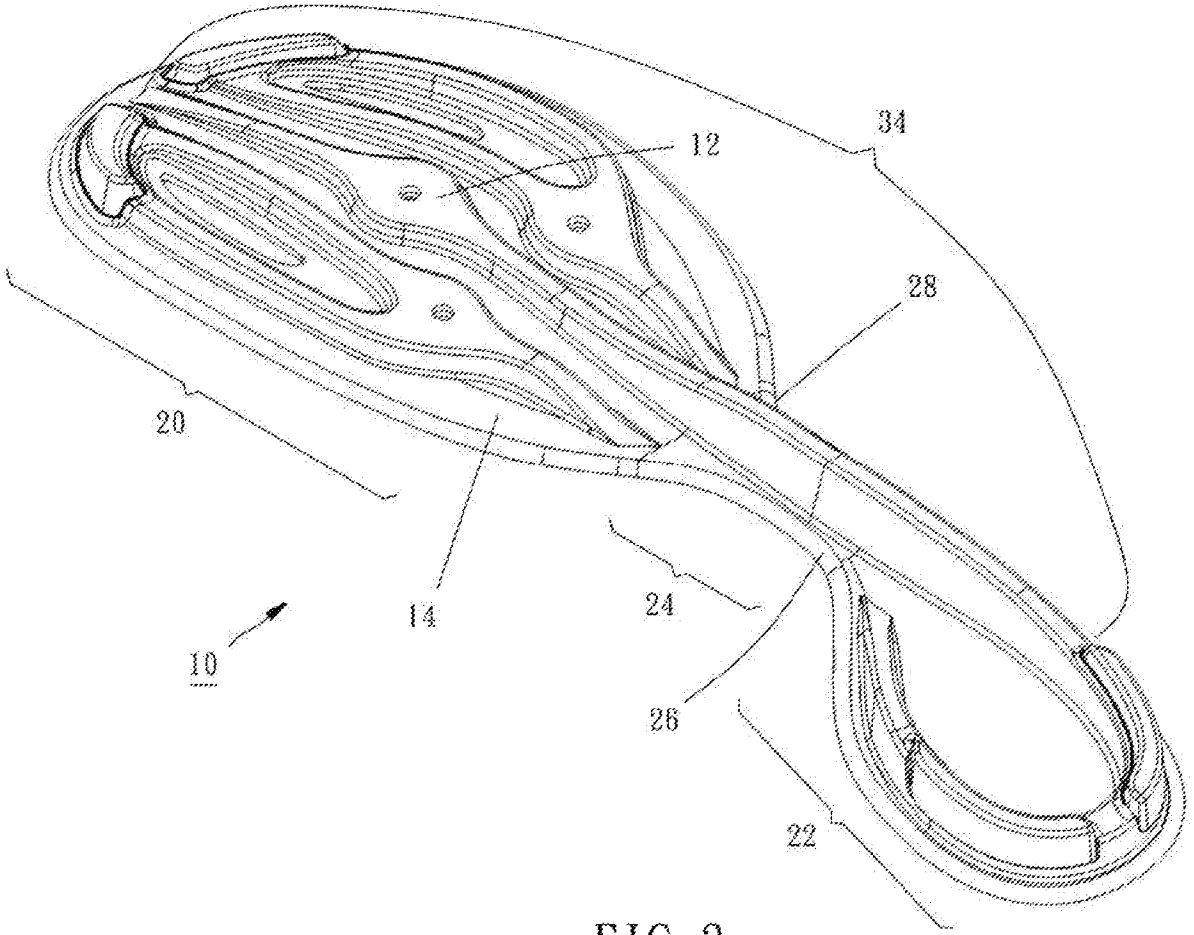
FIG. 3 is an oblique top elevational view of the sole for cycling shoe in accordance with the first embodiment of the present invention.

Referring to FIGS. 1-3, a sole in accordance with a first embodiment of the present invention is shown for a left hand-side road bike shoe. The sole 10 is made from a material having sufficient hardness and rigidity, such as carbon fiber, glass fiber, or hard rubber. Alternatively, the sole can also be made from a composite material, or combined materials.

The sole 10 comprises a forefoot section 20, a heel section 22, and an arch section 24 connected between the forefoot section 20 and the heel section 22. The forefoot section 20 includes a toe tip a. The heel section 22 includes a heel point h. In this embodiment, the arch section 24 defines an inner side edge 26 and an opposing outer side edge 28 that exhibit a concave arcuate form corresponding to each other, and thus, the width of the arch section 24 is smaller than the width of the forefoot section 20 and the width of the heel section 22. The forefoot section 20 comprises a mounting portion 12 located at a bottom wall thereof for the mounting of a pedal cleat (not shown) to clip on a pedal of a bicycle pedal system, such as Shimano Pedaling Dynamics (SPD) system or Crank Brother system. Further, a longitudinal axis 30 and a tilting axis 32 are defined between the forefoot section 20 and the heel section 22. The longitudinal axis 30 extends through a location near the center of the mounting portion 12 of the forefoot section 20 and a location near the center of the heel section 22. The tilting axis 32 and the longitudinal axis 30 define therebetween a deviation angle D. In this embodiment, the tilting axis 32 is disposed close to the center between the forefoot section 20 and arch section 24, and extends toward the inner side edge 26 of the arch section 24 at the deviation angle D.

As illustrated in FIGS. 1-3, the sole 10 further comprises a middle part 34 located on a bottom wall 14 thereof In this embodiment, the middle part 34 is an elongated rib extended from a front edge of the forefoot section 20 through the center of the mounting portion 12 and the arch section 24 to the heel section 22. The middle part 34 extends in the area between the forefoot section 20 and the arch section 24 along the longitudinal axis 30, and then through the junction between the forefoot section 20 and the arch section 24 and the whole area of the arch section 24 along the tilting axis 32, and then through the junction between the arch section 24 and the heel section 22 in a curved manner toward a border edge of the heel section 22. The height of the middle part 34 protruded over the bottom wall 14 in the arch section 24 is higher than that in the forefoot section 20 and the heel section 22. Based on the structural features of the middle part 34 described above, the sole 10 defines two opposing side wing portions 36 at two opposite sides of the middle part 34, where the rigidity of the middle part 34 is higher than that of the side wing portions 36.

When the sole 10 is used in a cycling shoe, the mounting portion 12 of the forefoot section 20 is fastened to a pedal by a pedal cleat. At this time, the force of the rider's foot can be directly applied to the pedal through the hard and rigid forefoot section 20 of the sole 10. Because the rigidity of the side wing portions 36 is lower than the rigidity of the middle part 34, the lateral rigidity of the sole 10 is lower than its longitudinal rigidity, and thus, when the rider is cycling the pedals, the sole of the foot can smoothly twist the arch section 24 and heel section 22 of sole 10 leftwards or rightwards, enhancing foot comfort.

Because the middle part 34 extends in the arch section 22 along the tilting axis 32 and because the height of the middle part 34 in the other areas is higher than height of the middle part 34 in the forefoot section 20 and the heel section 24, the extending direction of the middle part 34 in the middle part of the sole 10 is different from the extending direction of the middle part 34 in the forefoot section 20 and the heel section 24, i.e., the middle part 34 provides better support and torsionability to the arch of the sole of the foot, and can have optimal longitudinal rigidity with moderate lateral torsionability and flexibility. Further, the deviation angle D can be adjusted to fit different types or sizes of cycling shoes, enabling the extending direction of the middle part 34 to mate with the foot form and functional design features of the sole 10, so as to enhance the supportive and flexibility of the sole 10.

In conclusion, the sole 10 can provide more natural stampede rotary motion, and will not be affected by structural limitations of traditional bike shoe sole, increasing foot torsionability and mobility. The middle part 34 of the sole 10 maintains the overall rigidity of the sole 10 without affecting or reducing the pedaling force transmission efficiency. Further, the invention improves foot comfort in cycling, reduces ankle and knee stress concentration, and helps the rider reduce fatigue in long time riding to avoid sports injuries.

Figure 4:
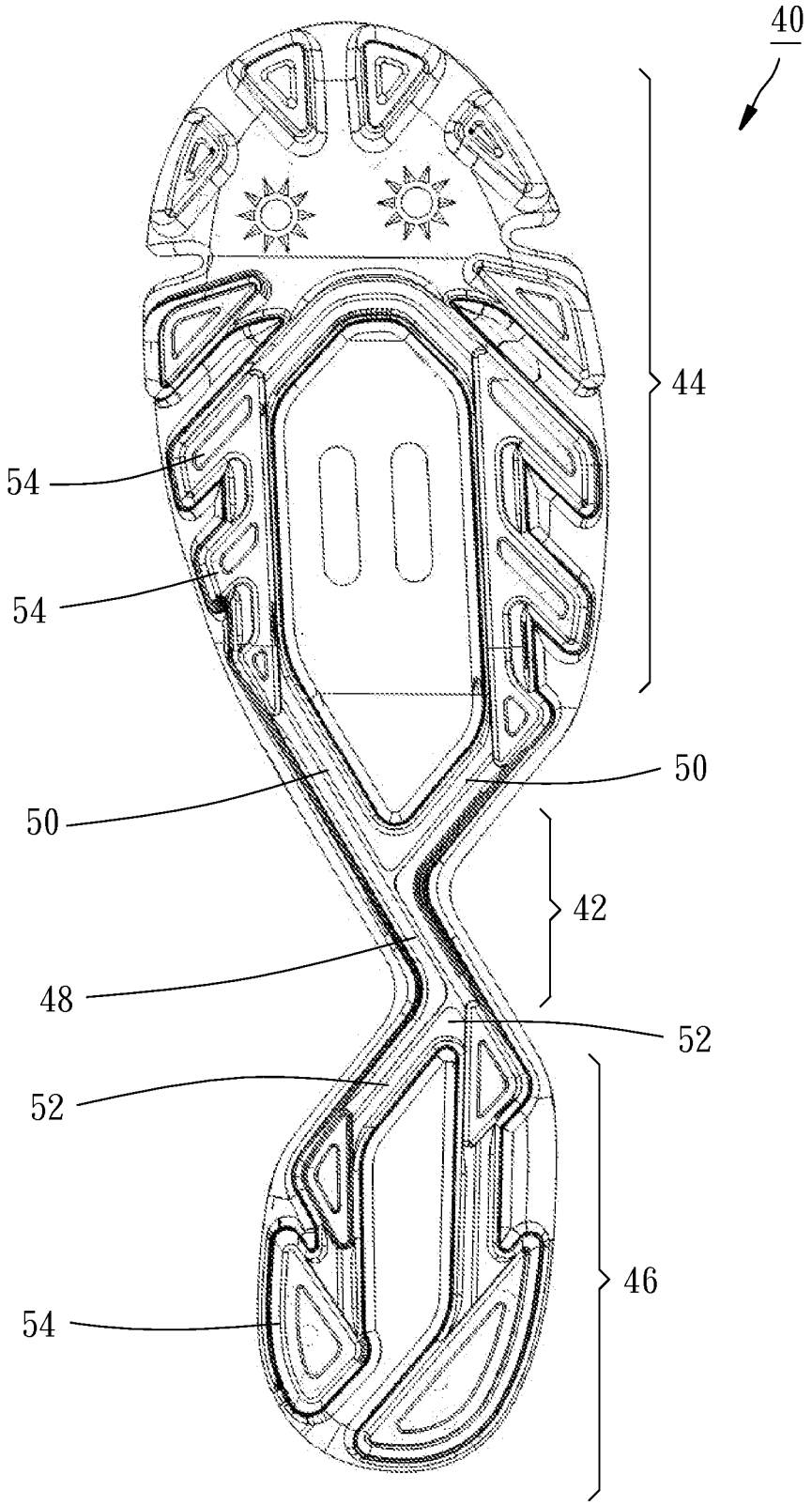
FIG. 4 is a front view of a sole for cycling shoe in accordance with a second embodiment of the present invention.
Figure 5:
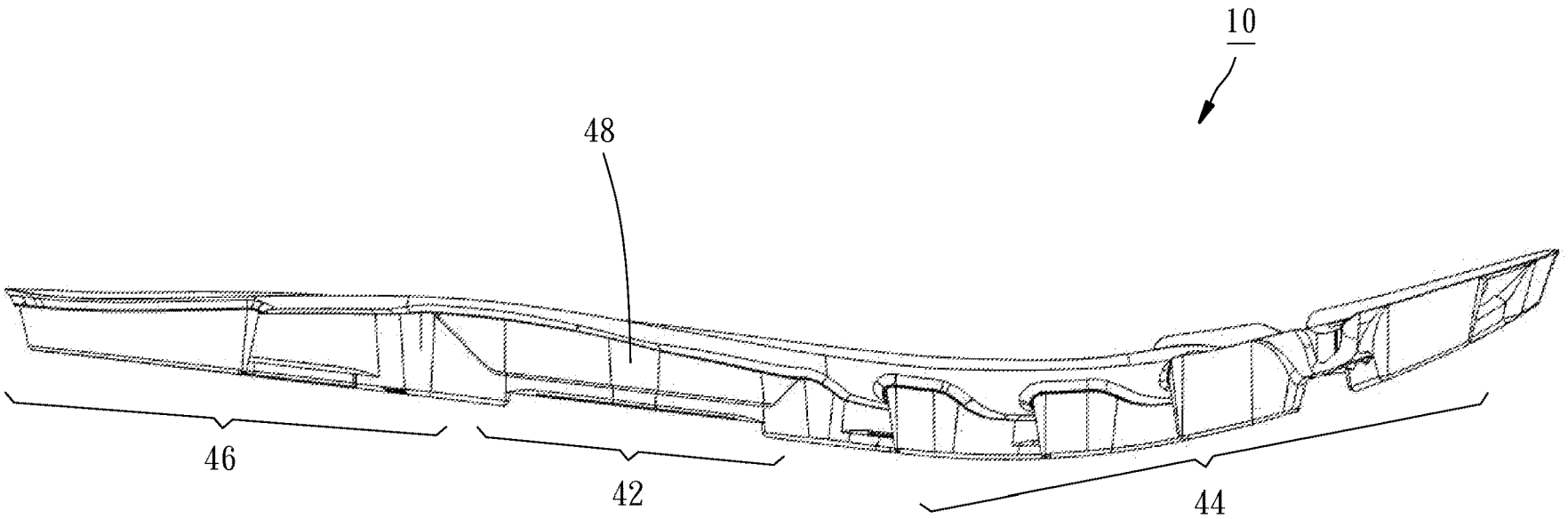
FIG. 5 is a side view of the sole for cycling shoe in accordance with the second embodiment of the present invention.
Figure 6:
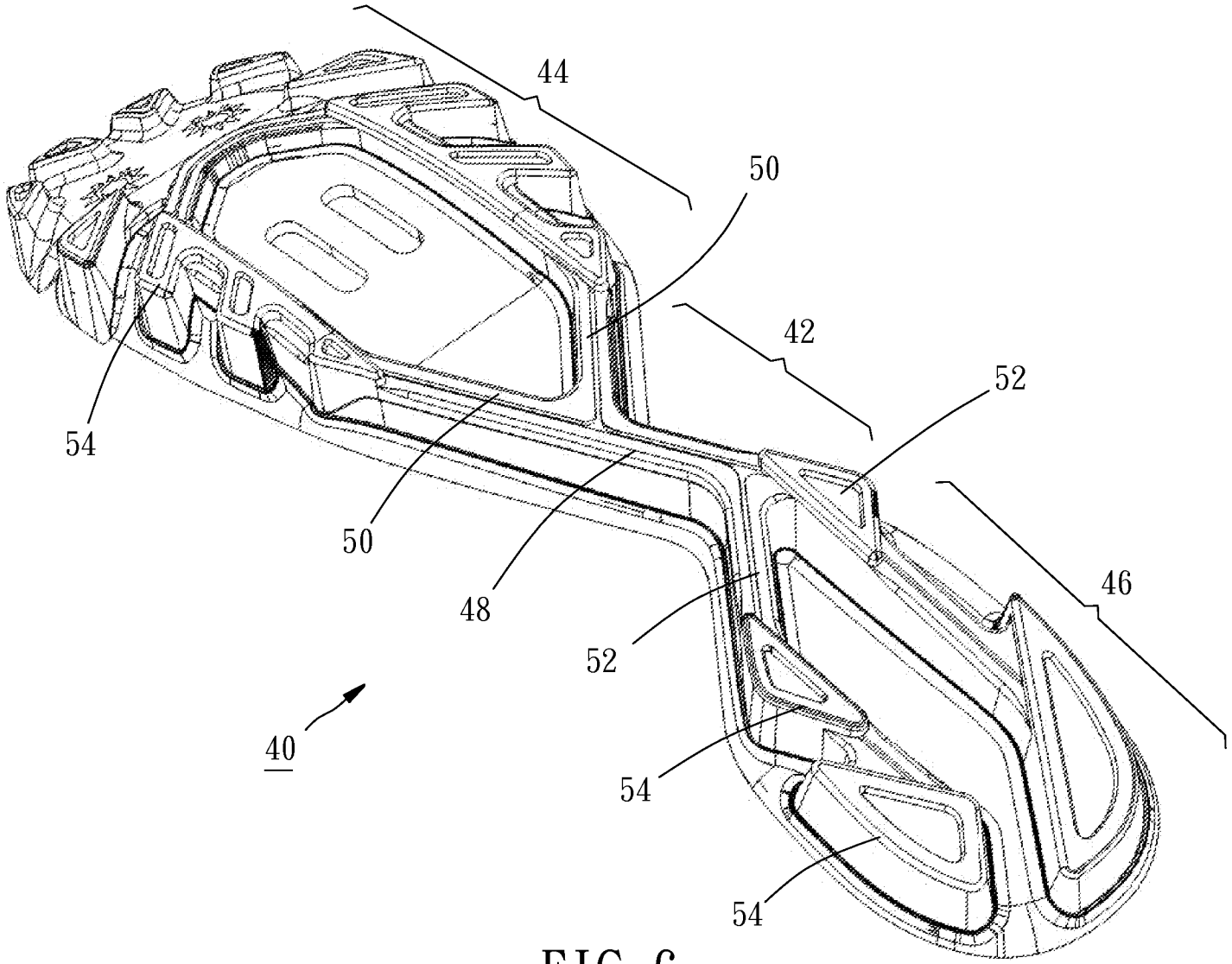
FIG. 6 is an oblique top elevational view of the sole for cycling shoe in accordance with the second embodiment of the present invention.

In order to be applicable to different types of cycling shoes or materials, the middle part of the sole in accordance with the present invention can also be changed to other alternate forms while maintaining the same technical features and effects of the present invention. FIGS. 4-6 illustrate a sole 40 for carbon fiber road bike shoe in accordance with a second embodiment of the present invention. Except the characteristic that the width of the arch section 42 of the sole 40 is smaller than the width of the forefoot section 44 and the width of the heel section 46, the middle part 48 comprises two first extension sections 50 located in the junction between the forefoot section 44 and the arch section 42, and two second extension sections 52 located in the junction between the arch section 42 and the heel section 46. The two first extension sections 50 are respectively forwardly extended from the inner side edge and outer side edge of the arch section 42 along the border of the forefoot section 44 and merged into each other to form a loop. The two second extension sections 52 are respectively backwardly extended from the arch section 42 along the border of the heel section 46. The middle part 48 further comprises a plurality of cushion blocks 54 located at each first extension section 50 and each second extension section 52 and protruding over the bottom wall of the sole 40.

Figure 7:
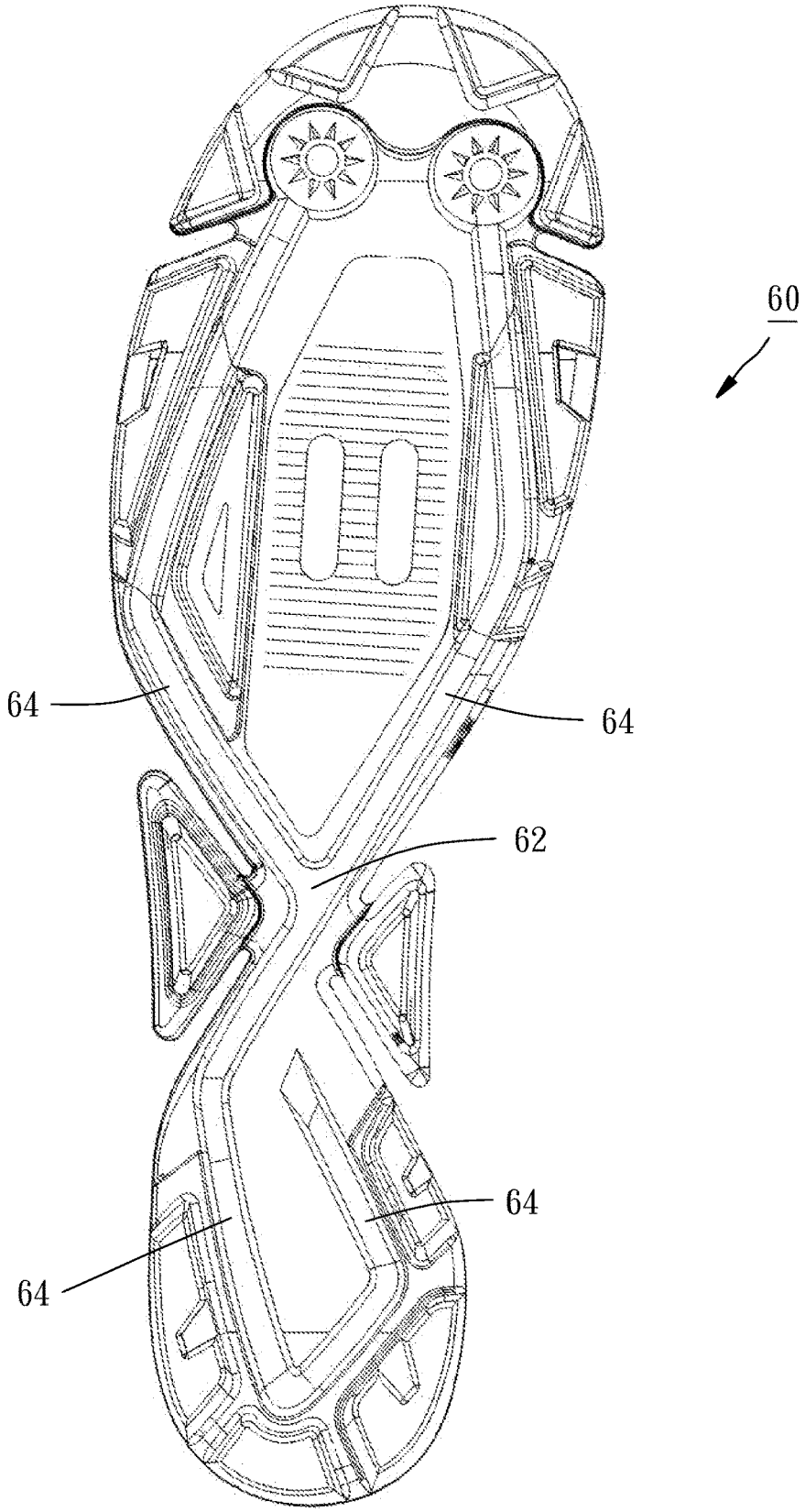
FIG. 7 is a front view of a sole for cycling shoe in accordance with a third embodiment of the present invention.
Figure 8:
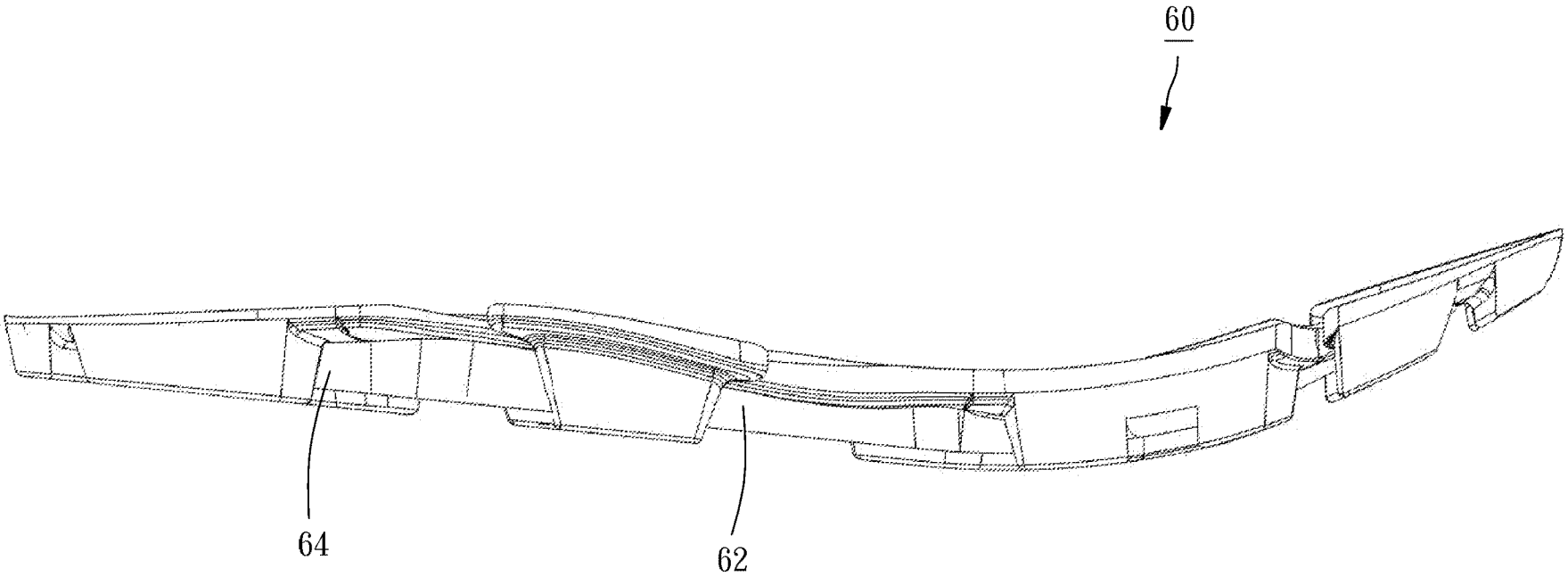
FIG. 8 is a side view of the sole for cycling shoe in accordance with the third embodiment of the present invention.
Figure 9:
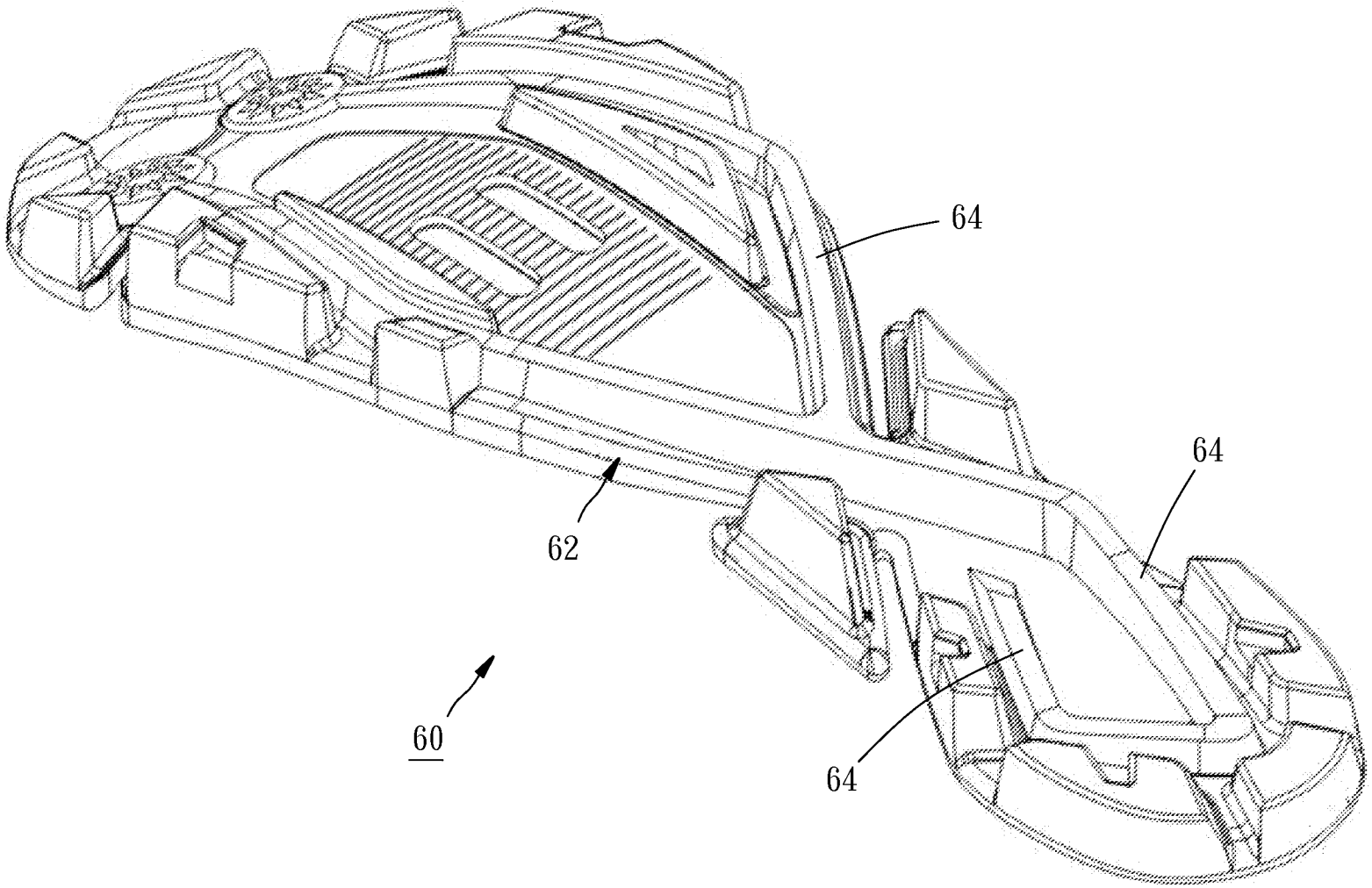
FIG. 9 is an oblique top elevational view of the sole for cycling shoe in accordance with the third embodiment of the present invention.

FIG. 7 illustrates a sole 60 for cycling shoe in accordance with a third embodiment of the present invention. According to this third embodiment, the sole 60 is made from nylon for step bike shoe. This third embodiment has technical features similar to that of the aforesaid second embodiment with the exception that the middle part 62 consists of a plurality of integrated straight extension sections 64, and thus, the technical features of this embodiment can mate with the tread groove design of the sole 60.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A sole for a cycling shoe, said sole comprising:

a forefoot section, a center of said forefoot section including a front toe edge;

a heel section, a center of said heel section including a rear heel edge; wherein the front toe edge and the rear heel edge define a longitudinal axis that extends between said front toe edge and said rear heel edge;

an arch section connected between said forefoot section and said heel section;

an elongated rib, wherein:

the elongated rib is formed in a J-shape and includes a first end and a second end;

the first end is located immediately adjacent the front toe edge of the forefoot section, and the second end is located within a junction area between the arch section and the heel section;

the elongated rib extends in a rearward direction from the first end through a central region of each of the forefoot section and the arch section, extends through the heel section, curves at the rear heel edge, and then extends in a forward direction towards said junction area between the arch section and the heel section; and portions of the elongated rib extending through at least the forefoot section and the arch section are disposed at a tilt relative to said longitudinal axis; and two side wing portions disposed in said forefoot section at two opposite sides of said elongated rib;

wherein the elongated rib has a higher rigidity than a rigidity of each of said two side wing portions, such that a longitudinal rigidity of the sole is higher than a lateral rigidity of the sole, so as to provide support to a wearer's foot while allowing the wearer to twist the sole during a pedaling motion to increase foot comfort and reduce fatigue.

2. The sole of claim 1, wherein said forefoot section comprises a mounting portion located at a bottom wall of the forefoot section; said elongated rib extending from the front toe edge of said forefoot section through a center of said mounting portion toward said arch section.

3. The sole of claim 2, wherein a width of the mounting portion is greater than a width of the elongated rib at said arch section and a width of the elongated rib at said heel section.

4. The sole of claim 1, wherein a height of said elongated rib protruding over a bottom wall in said arch section is higher than each of a height of said elongated rib protruding over the bottom wall in said forefoot section and in said heel section.

5. The sole of claim 1, wherein said arch section further comprises an opposing outer side edge and an inner side edge, said inner side edge and said opposing outer side edge exhibiting a concave arcuate form corresponding to each other; a width of said arch section being smaller than a width of said forefoot section and a width of said heel section.

6. The sole of claim 1, wherein said forefoot section comprises a mounting portion located at a bottom wall of the forefoot section for the mounting of a pedal cleat.

7. The sole of claim 1, wherein said sole is made from a composite material, or combined carbon fiber materials.

* * * * *